United States Patent [19]

Sodec

[11] Patent Number: 5,054,379

[45] Date of Patent: Oct. 8, 1991

[54] AIR RELEASE BOX

[75] Inventor: Franc Sodec, Wuerselen-Broichweiden, Fed. Rep. of Germany

[73] Assignee: H. Krantz GmbH & Co., Aachen, Fed. Rep. of Germany

[21] Appl. No.: 537,043

[22] Filed: Jun. 12, 1990

[30] Foreign Application Priority Data

Jul. 3, 1989 [DE] Fed. Rep. of Germany ..... 3921813

[51] Int. Cl.[5] ..... F24F 7/10; F24F 13/068

[52] U.S. Cl. ..... 98/40.05; 98/40.1

[58] Field of Search ..... 98/40.11, 40.1, 40.05, 98/40.18, 40.01, 38.4, 38.3

[56] References Cited

U.S. PATENT DOCUMENTS

| | | | |
|---|---|---|---|
| 2,859,681 | 11/1958 | Rachlin | 98/40.11 |
| 3,327,607 | 6/1967 | Newell et al. | 98/40.11 |
| 3,419,714 | 12/1968 | Slauer | 98/40.09 |
| 3,938,430 | 2/1976 | Koppang | 98/110 |
| 4,131,059 | 12/1978 | Gustawsson | 98/40.18 |
| 4,207,864 | 6/1980 | Fischer et al. | 98/110 |
| 4,372,196 | 2/1983 | Henderson | 98/40.11 |
| 4,955,286 | 9/1990 | Müller | 98/40.11 |

FOREIGN PATENT DOCUMENTS

| | | | |
|---|---|---|---|
| 0271652 | 6/1988 | European Pat. Off. | 98/40.1 |
| 3643175 | 6/1988 | Fed. Rep. of Germany . | |
| 0297656 | 12/1987 | Japan | 98/40.11 |
| 0932135 | 5/1982 | U.S.S.R. | 98/40.01 |
| 0591207 | 8/1947 | United Kingdom | 98/40.1 |

*Primary Examiner*—Albert J. Makay
*Assistant Examiner*—William C. Doerrler
*Attorney, Agent, or Firm*—W. G. Fasse

[57] ABSTRACT

An air release box has at least one perforated bottom wall section and perforated longitudinal side wall sections. At least certain of the perforated wall sections, including the perforated bottom wall section, are equipped with spin air outlets for increasing the penetration depth of low turbulence air jets into a room. Without such spin air outlets the low turbulence air jets tend to be unstable at relatively low exit velocities. The tendency of these air jets to quickly decay is thus delayed. The highly turbulent air jets exiting from said spin air outlets do not entrain air in the room, but rather they entrain inlet air coming through the perforated wall sections neighboring the spin air outlets. Thus, the jet impulse imparts a high stability to the inlet air jets.

12 Claims, 2 Drawing Sheets

AIR RELEASE BOX

FIELD OF THE INVENTION

The invention relates to an air release box which is, for example, useful in connection with an air cleaner system for returning cleaned air into a room, such as a factory.

BACKGROUND INFORMATION

Such air release boxes frequently have a trapezoid configuration with a cover closing a box housing. A connection air inlet is secured to the box cover and the bottom has three perforated sections opposite the cover. One central bottom section is located opposite the air inlet while two laterally connecting bottom sections slant upwardly.

German Patent Publication (DE) 3,643,175 Al discloses an air release box of the just described type. The conventional air release box comprises air exit openings in its box bottom. These openings are distributed in the form of rows of air exit nozzles passing through the surface of the box bottom. The on-center spacing of these air exit nozzles corresponds at least to three times the exit nozzle diameter. On-center spacings of the nozzles up to twelve times the nozzle exit diameter, are conventional. This type of conventional nozzle arrangement is intended to make sure that a substantially smaller air volume flow is sufficient in order to achieve a stable displacement flow as compared to other conventional devices without such nozzle distribution.

It is advantageous for production plants having an intensive dust generation, such as cotton mills, to equip these production facilities with air release boxes having a low turbulence air jet characteristic. In this manner it is intended to reduce the dust whirl-up or the raising of dust in a confined manufacturing space. If the inlet air is blown out with a low turbulence above the machinery, the low turbulence air jets displace the dust particles toward the floor, thereby reducing the dust concentration at higher levels above the manufacturing floor.

Conventional air release boxes used heretofore in such manufacturing plants have been so constructed that the highly inductive air jets are produced with a substantial reach. Such highly inductive air jets with a large reach produce so-called air cylinders in the respective manufacturing space which permit maintaining a uniform room temperature distribution and a uniform relative humidity distribution in the respective manufacturing hall. However, due to the increased manufacturing capacity or productivity of manufacturing machinery, the dust generation is so large, especially in textile factories, that the technique of the so-called "space air cylinders" is no longer satisfactory. Such space air cylinders have highly inductive air jets, as mentioned, which lead to an uncomfortable dust concentration which results in a uniform distribution of the dust particles over the entire production hall.

OBJECTS OF THE INVENTION

In view of the foregoing it is the aim of the invention to achieve the following objects singly or in combination:

to improve an air release box of the type mentioned above in such a way that still fewer dust particles are mixed with the air in a room or manufacturing hall and that still fewer dust particles are distributed over the entire room volume;

to achieve an improved displacement of the dust particles in the direction toward the floor of the respective space so that the dust concentration is further reduced at the levels where people are breathing; and to control the outflow of air from an air release box in such a way that the air flow suppresses a lifting type of movement of dust particles.

SUMMARY OF THE INVENTION

The above objects are achieved according to the invention in that in addition to at least one perforated box bottom section there are two perforated side wall sections which, together with the end walls which are not perforated, connect the bottom sections to the cover which carries the connection air inlet. Additionally, air spin outlet means are arranged at least in the central perforated bottom wall section and in the perforated side wall sections for releasing air through said spin outlet means and through the perforated wall sections.

The just mentioned features of the invention have the advantage that the spin outlets cooperate with apertures formed by the perforations in wall sections in a surprisingly efficient manner toward the intended purposes. More specifically, the airflow out of the apertures formed in the perforated wall sections of the box housing, is naturally low turbulence as the diameters of these apertures are small. The smaller the aperture diameters, the smaller is the turbulence. Thus, it is possible to achieve an air exit velocity in the range of 0.2 to 2.0 m/sec by selecting the proper perforation or aperture diameter. However, low turbulence air jets are rather instable and have a tendency to quickly decay at these rather small air exit velocities. In order to prevent such decay and instability, and to increase the penetration depth of the air jets into the space into which the air is released, the air release box according to the invention is also equipped with so-called spin outlets. Air jets coming out of such spin outlets are rather highly turbulent. However, such turbulent air jets induce or entrain the inlet air coming out of neighboring perforations or apertures, thereby leaving the air in the room into which the inlet air is released, substantially uninfluenced. The spin outlets thus have the purpose of increasing the stability of the total exiting air jets with the aid of a larger jet impulse.

According to an especially advantageous embodiment of the invention, the perforated bottom wall sections and the perforated side wall sections of the present air release box are constructed in the form of perforated sheet metal wall sections having apertures with a diameter within the range of 2 to 15 mm, preferably within the range of 3 to 8 mm, whereby the on-center spacing of these apertures is so selected that the free through-flow cross-sectional area takes up 15 to 50% preferably 20 to 30%, of the respective wall section surface area.

The above mentioned spin outlets are preferably arranged in rows in the respective perforated wall sections, whereby uniform, on-center spacings are provided between neighboring spin outlets in a preferred arrangement.

Another improvement is seen in the arrangement of two baffle guide plates inside the air release box. Preferably, these guide plates are hinged to axes extending in parallel to the longitudinal central box axis so that the guide plates are angularly adjustable to divert the incoming air in a uniform distribution into several box compartments. Particularly, the air flow in a straight downward direction toward the center perforated bottom wall section, can be effectively controlled by the baffle plates. Stop means may be provided to hold the baffle plates in an adjusted position.

The air release box according to the invention may be mounted either directly under the ceiling of a room, or manufacturing hall, or it may be suspended from the ceiling with a suitable spacing between box cover and ceiling.

BRIEF DESCRIPTION OF THE DRAWINGS

In order that the invention may be clearly understood, it will now be described, by way of example, with reference to the accompanying drawings, wherein.

DETAILED DESCRIPTION OF A PREFERRED EXAMPLE EMBODIMENT AND OF THE BEST MODE OF THE INVENTION

Figure 1:
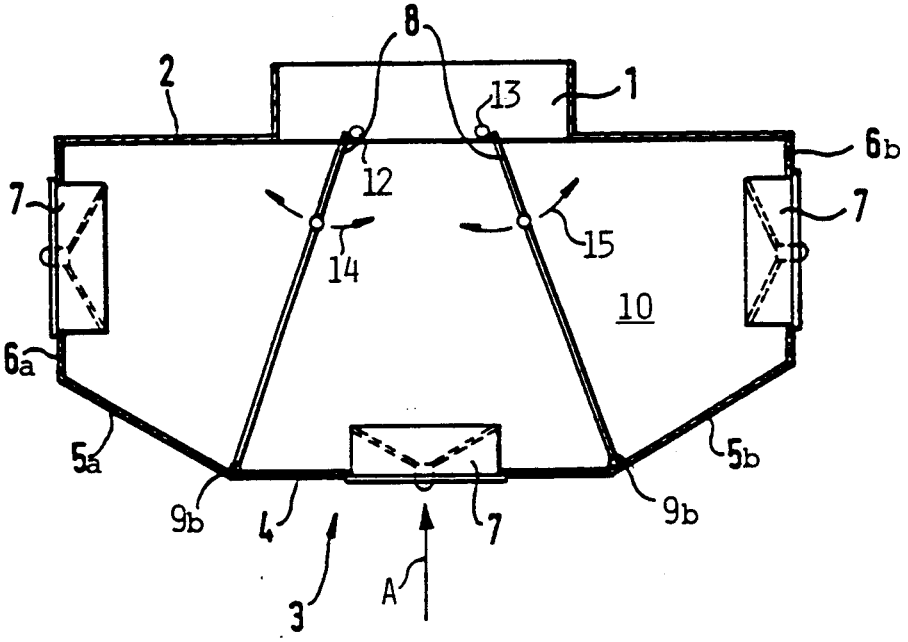
FIG. 1 is an axial longitudinal view into an air release box according to the invention with one end wall removed to show the guide baffle plates.

Referring to FIG. 1, the present air release box comprises a connection air inlet 1 forming part of a cover 2 arranged opposite a bottom 3. The bottom 3 comprises three bottom wall sections 4, 5*a*, and 5*b*, whereby the perforated wall section 4 forms a central wall section between the lateral slanted bottom wall section 5*a* and 5*b*. These lateral wall sections 5*a* and 5*b* slope upwardly away from the central section 4 along a hinging axis 9*a* and 9*b* respectively. Two perforated side wall sections 6*a* and 6*b* connect the sloping bottom wall sections 5*a* and 5*b* to the cover 2. These side wall sections, or rather longitudinal side wall sections 6*a* and 6*b* extend vertically and connect to the end walls 10 and 11, as well as to the cover, and to the slanting wall sections. Of the bottom wall sections, at least the central section 4 will be perforated. However, the slanting lateral bottom wall sections 5*a* and 5*b* are preferably also perforated.

Figure 3:
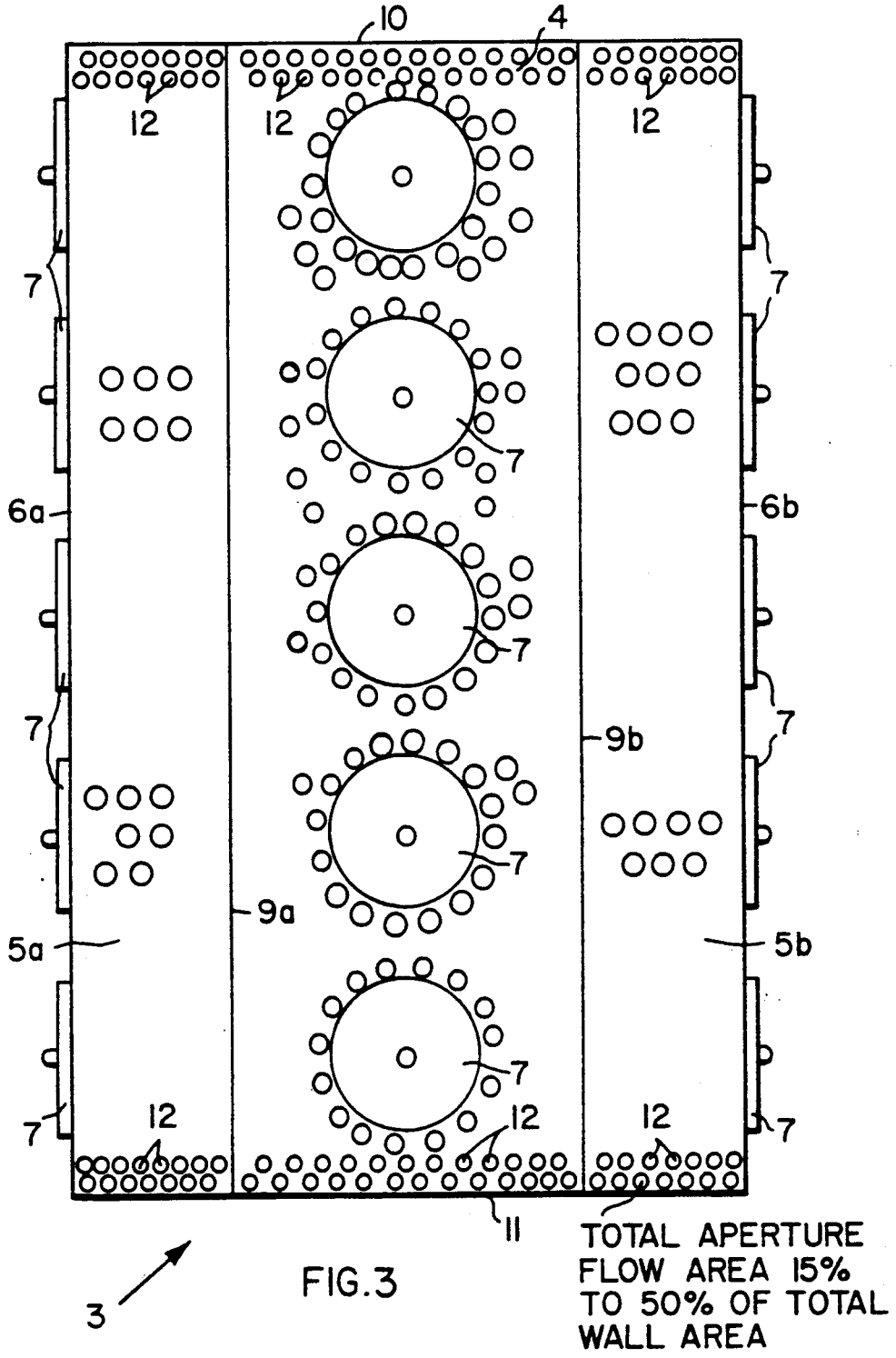
FIG. 3 is a view in the direction of the arrow A in FIG. 1 to show the in-row arrangement of the spin air outlets.

Referring to FIG. 3, only a few of the apertures 12 are shown. However, the apertures 12 will be distributed as disclosed above so that the through-flow area will take up at least 15 to 50%, preferably 20 to 30%,of the total wall surface area of these sections which are, for example, made of sheet metal. The end walls 10, 11 and the cover 2 are not perforated.

The above mentioned spin outlets 7 are best seen in FIG. 3 where it is shown that these spin outlets 7 are arranged in rows in their respective perforated wall sections with uniform, on-center spacings between neighboring spin outlets 7. FIG. 3 also shows how the apertures 12 surround the spin outlets 7.

As shown in FIG. 1, the guide baffle plates 8 are hinged to respective hinging axes 9*a* and 9*b*, whereby these baffle plates are adjustable, as indicated by the arrows 14 and 15. Preferably, adjustable stops 12 and 13 are provided to hold the baffle plates 8 in an adjusted position to determine the quantity of air that is directed directly downwardly toward the central bottom wall section 4.

Figure 2:
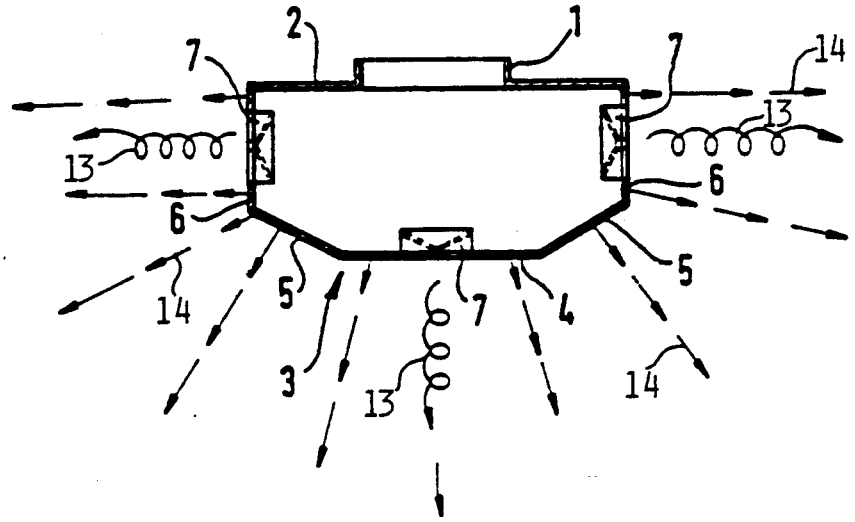
FIG. 2 is a view similar to that of FIG. 1, but showing the air flow patterns out of the present box on a reduced scale.

Referring to FIG. 2, the spin flows 13 coming out of the spin outlets 7 entrain the low turbulent flows 14, thereby stabilizing these flows and enabling them to have a larger penetration depth into the space into which the air is to be released.

Although the invention has been described with reference to specific example embodiments, it will be appreciated that it is intended to cover all modifications and equivalents within the scope of the appended claims.

What I claim is:

1. An air release box for supplying air into a confined space, comprising wall means interconnected to form a box housing, a cover for said box housing, a connection air inlet in said cover for introducing air into said box housing, said wall means including a box bottom opposite said air inlet, said box bottom having a central perforated bottom wall section with apertures for releasing a low turbulence air flow, said box bottom including two further bottom wall sections slanting in opposite directions away from said perforated central bottom wall section, said wall means further including end walls and perforated side wall sections connecting said bottom wall sections to said cover, said perforated side wall sections having apertures for releasing a low turbulence air flow, and air spin outlet means at least in said central perforated bottom wall section and in said perforated side wall sections for releasing a high turbulence air flow through said spin outlet means, said air spin outlet means being surrounded by said apertures so that said high turbulence air flow through said spin outlet means entrains said low turbulence air flow through said apertures, whereby the stability of the entire air flow into said space is increased.

2. The air release box of claim 1, wherein said apertures of said perforated side wall sections and said apertures of said perforated central bottom wall section have an aperture diameter within the range of 2 to 15mm, said apertures being spaced from one another so that a free crosssectional flow area takes up about 15% to 50% of a total wall area of the respective perforated wall section.

3. The air release box of claim 2, wherein said aperture diameter is within the range of 3 to 8 mm.

4. The air release box of claim 2, wherein said free cross-sectional flow area takes up 20% to 30% of the total wall area of the respective perforated wall section.

5. The air release box of claim 1, wherein said box housing has a longitudinal axis, said spin outlet means comprising a plurality of spin outlets arranged in rows alongside said longitudinal axis in at least certain of said perforated wall sections and so that each of said spin outlets is surrounded by said apertures.

6. The air release box of claim 5, wherein said spin outlets are uniformly spaced from each other in said rows.

7. The air release box of claim 1, further comprising air guide baffle means inside said box housing, said air guide baffle means extending from said bottom wall sections toward said air inlet.

8. The air release box of- claim 7, wherein said air guide baffle means comprise two baffle plates, and hinge means for tiltably securing said baffle plates to said bottom wall sections.

9. The air release box of claim 8, wherein said hinge means are located where said two further bottom wall sections join said central perforated bottom wall section.

10. The air release box of claim 8, further comprising means for locking said two baffle plates in an adjusted position for a desired air distribution from said air inlet into said box housing.

11. The air release box of claim 1, wherein said further bottom wall sections also comprise air outlet apertures.

12. The air release box of claim 11, wherein said air outlet apertures in said further bottom wall sections have a diameter within the range of 2 to 15 mm, and wherein a total free flow area through all apertures takes up about 15 to 50% of the total wall area.

* * * * *